US005121925A

United States Patent [19]

Blundo

[11] Patent Number: 5,121,925

[45] Date of Patent: Jun. 16, 1992

[54] GOLF SWING TRAINING CLUB

[76] Inventor: Frank Blundo, 59 Allen Rd., Billerica, Mass. 01821

[21] Appl. No.: 786,568

[22] Filed: Nov. 1, 1991

[51] Int. Cl.[5] ..... A63B 69/36

[52] U.S. Cl. ..... 273/193 A; 482/109

[58] Field of Search ..... 273/193 R, 193 A, 193 B, 273/186 A, 183 D, 194 R, 194 A, 194 B; 272/124

[56] References Cited

U.S. PATENT DOCUMENTS 3,351,346 11/1967 Strahan ..... 273/193 A
4,754,978 7/1988 Dworacek ..... 273/193 R

*Primary Examiner*—George J. Marlo

*Attorney, Agent, or Firm*—Ernest V. Linek

[57] ABSTRACT

The present invention relates to a golf swing training and muscle exercising apparatus (or "club") which includes a shaft having the non-grip end thereof bent at about 22.05 degrees and on which rotatable off-center swing weights are mounted which enables a user to simulate the movements of a proper golf swing and which also exercises the muscles of the golfer making such a swing. Two embodiments are provided in this invention, each based upon the same design principle. One embodiment is intended for use outdoors, e.g., at the driving range or even on the course. The other embodiment, is preferably intended for use indoors, but can be used anywhere.

12 Claims, 2 Drawing Sheets

GOLF SWING TRAINING CLUB

FIELD OF THE INVENTION

The present invention relates to a golf swing training and muscle exercising apparatus (or "club") which enables a user to simulate the movements of a proper golf swing and which also exercises the muscles of the golfer making such a swing. Two embodiments are provided in this invention, each based upon the same design principle. One embodiment is intended for use outdoors, e.g.. at the driving range or even on the course. The other embodiment, is preferably intended for use indoors, but can be used anywhere.

BACKGROUND OF THE INVENTION

In playing the game of golf, optimum shot making performance is achieved when a golf club is swung on a precise plane in what is commonly referred to as an "inside to outside" swing path, using specific muscle groups to maximize the energy transfer from the club head to a golf ball. The training clubs of the present invention promote the development of a smooth, fluid, inside to outside swing path, while conditioning the muscles to develop a memory of the proper swing.

The path of movement of a struck golf ball is primarily determined by the path of movement of the golf club prior to engaging the ball. Hence, a golf club moving through the proper path of movement will result in the struck ball being impelled in the desired direction with a minimum of "slice," "hook" or other objectionable spin being imparted to the ball. Most inconsistencies in the direction of the ball movement by golfers result from an improper and misoriented swing.

A number of golf club training and guiding devices have been proposed for training golfers with respect to maintaining the proper golf club movement while addressing and striking a golf ball. See, for example, U.S. Pat. Nos. 3,583,707; 3,341,208; 3,339,927; 2,756,056; 2,520,287; 1,944,942; and 1,567,530. Most of these patents utilize rings and/or arc devices for aiding the golfer during the golf club swing and several of these devices utilize guides wherein the club may be connected to a ring or arc to indicate to the golfer the proper club swing movement. While such devices may provide help to certain golfers, they may be viewed by others as overly complicated, cumbersome, etc., which will lead at first, to a scantiness of use, and ultimately to total non-usage by the golf student.

Other swing training clubs and related devices have been proposed. See, for example, U.S. Pat. Nos. 5,050,874; 4,653,757; 4,580,786; 4,262,573; 4,229,002; 3,738,661; 3,703,294; 3,614,108; 3,462,156; 3,429,571; 3,319,963; 2,848,234; 2,328,408; and 1,893,920, to mention but a few. Many of these devices are viewed as being too large, heavy and expensive to be portable and are impractical and incapable of convenient use, and/or commercial distribution.

SUMMARY OF THE INVENTION

As discussed above, the present invention relates to a golf swing training and muscle exercising apparatus (or "club") which enables a user to perform the movements of a proper golf swing and which also exercises the muscles of the golfer making such a swing. Two embodiments are provided in this invention, each based upon the same design principle. One embodiment is intended for use outdoors, e.g., at the driving range or even on the course. The other embodiment, is preferably intended for use indoors, but can be used anywhere.

It is thus an object of the present invention to provide golf club swing training clubs wherein the apparatus permit the golfer to be comfortable and utilize the golfer's most natural swing movement. Another object of the invention is to provide golf club swing training clubs which may be easily used by a wide variety of golfers of various sizes and which permit the golfer to use the devices without unusual skills or complex instruction. A further object of the present invention is to provide a golf club swing training club which is made up of components which may assembled and modified as desired, without extraordinary skills or special tools.

Thus, in one preferred embodiment, the present invention provides an indoor training club, which, despite its short length, actually feels and swings like a full size golf club. The indoor embodiment of the present invention consists of a short (about 15–25, preferably about 20 inches long), angled shaft, with a conventional golf grip at one end. At the opposite end of the shaft is the rotational weight member of this invention. One, two, three, or more rotatable swing weights are provided at the end of the angled shaft. The weights are mounted to the shaft in an off-set (i.e., off-center) manner, so that as the golf swing is initiated, the weights can and will rotate freely. During the backswing, the weights promote a slow take away, and promote a proper inside to outside swing path. During the downswing, the weights shift, causing the hands to automatically release, returning the club to its most desirable impact position.

The swing weights are advantageously made from rubber so as to afford safety for use inside the home or office. The swing weights are sleeve bearing loaded, to operate on the axle sleeve, so that they will turn smoothly without hesitation or drag, enabling user to incorporate unit weight transfer with their own weight transfer, producing a full controlled, smooth swing.

As the indoor club is used, the golfer can feel the proper backswing, and on the downswing, feel the release and hand turn. The short length of the club allows for a full and complete backswing, downswing, and follow through. The rotational weights on the end of the angled shaft make the club feel like a full size golf club. The use of one, two, three, or more adjustable weights, makes the indoor club embodiment of this invention very versatile, e.g., as a teaching aid or as a tune-up, or warm-up club, or even as a club for building u or toning up the golf swing muscles.

It is anticipated that any golfer who incorporates the use of the indoor embodiment of this invention into a daily, casual practice (e.g., 100 swings per day) session, e.g., at home, in the office, or at any other convenient place, will become a more consistent and confident golfer. Muscle memory of a full and easy swing will be developed, and this muscle memory will be readily transferred to the golf course, leading to more consistent shots, and better scores.

In the second preferred embodiment of the present invention, there is provided an outdoor training club, which, consists of a full size golf club (e.g., the driver—but any club may be used), modified at the grip end to incorporate the swing weight attachment which consists of a short (about 15–25, preferably about 20 inches long), angled shaft. At the free end of the angled shaft is the rotational weight member of this invention.

The long golf club shaft and the angled weight shaft are independent units bonded together with a resilient adhesive, as well as with a mechanical bond. The club head feel and control is not affected by the presence of the independent weight member.

As with the indoor model, one, two, three, or more rotatable weights are provided at the end of the angled shaft. The weights are mounted to the angled shaft in an off-set (i.e., off-center) manner, so that as the golf swing is initiated, the weights can and will rotate freely. During the backswing, the weights promote a slow take away, and promote a proper inside to outside swing path. During the downswing, the weights shift, causing the hands to automatically release, returning the club to its most desirable impact position.

As the outdoor club is used, the golfer can feel the proper backswing, and on the downswing, feel the release and the hand turn. With this club, one can actually strike the golf ball, thereby obtaining instant visual feedback as to the effectiveness of this training device. It is believed that using this club at the driving range, and even on the golf course itself, will enable the golfer to develop a smooth and easy swing, which will translate to lower scores.

Both the indoor and the outdoor embodiments of this invention are designed to create a swing which eliminates hooks and/or slices, increase overall accuracy, promote a proper hand turn (release) and promote a slow, controlled swing.

The novice golfer who utilizes one or, preferably both embodiments of the present invention in his or her practice sessions, will feel for the first time, a smooth, controlled, fully extended golf swing. The novice golfer will experience:

The hand turn

The inside to out swing path

The rotation of shoulders, arms, hips and legs as the entire body participates in the proper swing movements, forming the perfect golf swing.

It is believed that by practicing slow easy swinging with the training clubs of the present invention for ten minutes a day, all golfers, novice, intermediate, and advanced players, will find that they can decrease the number of mishits, eliminate hooks and/or slices, and prevent (or undue) bad habits which acquired using other training aids.

To use either of the training clubs of the present invention, apply and maintain a proper grip, stance and setup. Begin a slow sweeping take away. On completion of take away, begin a slow, easy decline through the ball. You will feel your leg, shoulder, hip, arm, wrist and finally your hand muscles, participating in the movements leading to a high finish of the perfect golf swing. Fast and hard swinging is not necessary. The outdoor embodiment is designed for accurate ball striking. It almost swings itself. Practice indoors with the indoor embodiment and outdoors with the outdoor embodiment. The two clubs together represent the perfect two step way of keeping the ball in play.

DETAILED DESCRIPTION OF THE PREFERRED EMBODIMENTS

Figure 1:
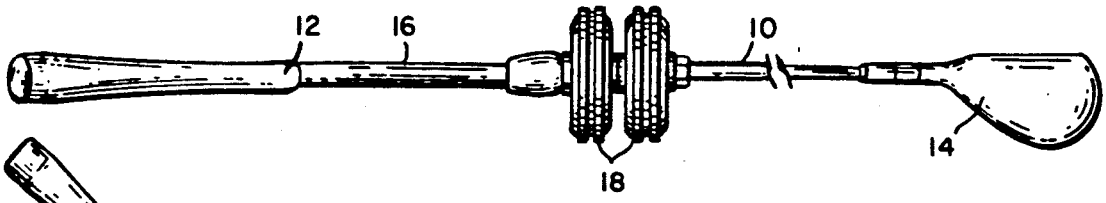
FIG. 1 shows a top plan view of one embodiment of the golf swing training and exercising apparatus of the present invention.
Figure 2:
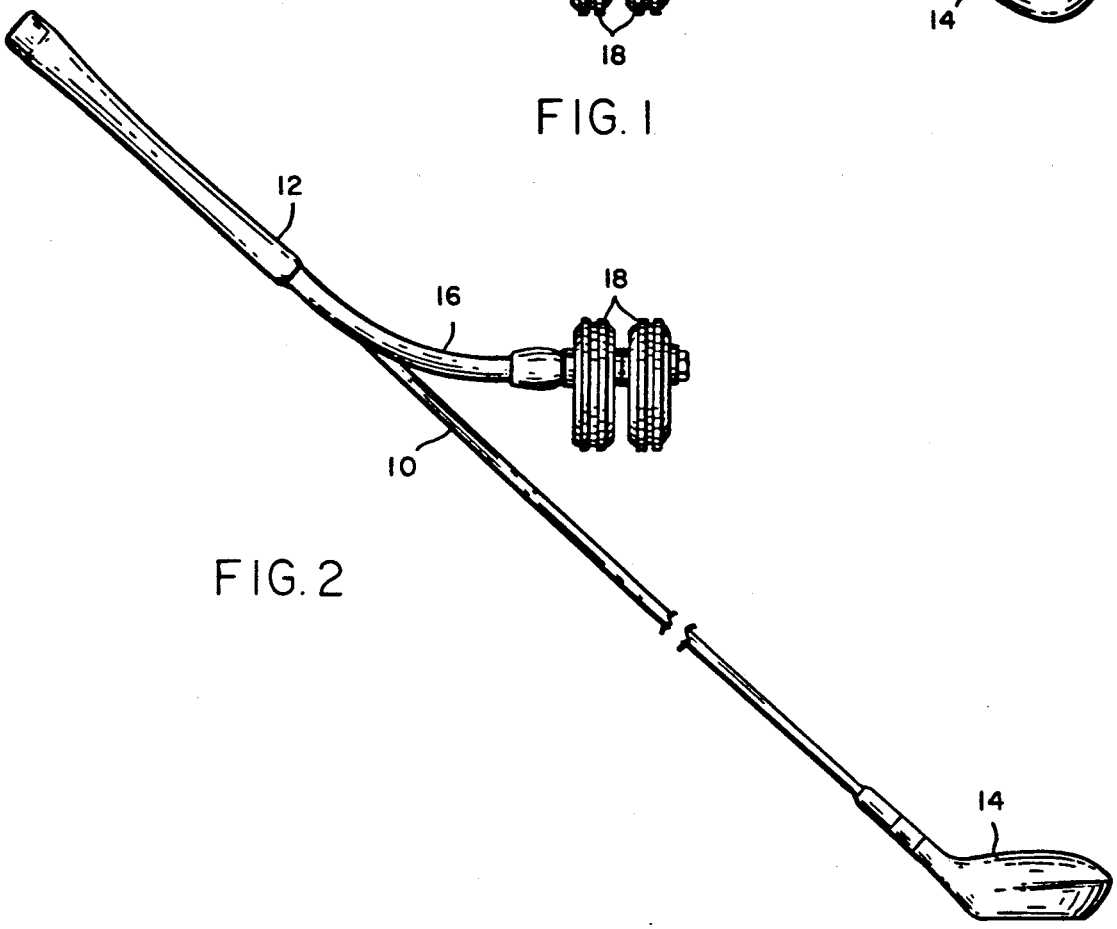
FIG. 2 shows a side elevational view of the apparatus of FIG. 1.
Figure 3:
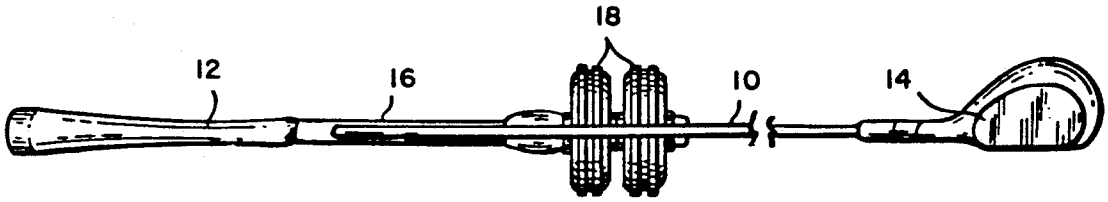
FIG. 3 shows a top bottom plan view of the apparatus of FIG. 1.

An example of the outdoor embodiment of a swing training device in accordance with the present invention is illustrated in FIGS. 1, 2 and 3. As illustrated, the main elements of this embodiment of the swing trainer according to the teachings of this invention are:

(a) the main golf club shaft 10;
(b) the grip 12;
(c) the club head 14;
(d) the angled weight shaft 16; and
(e) swing weights 18.

Each of the main elements of the device may be broken down into their respective functions according to the features offered to the user.

In the case of the golf swing trainer illustrated in FIGS. 1, 2 and 3, the conventional portions, well recognized by those skilled (and unskilled) in golf, are the conventional shaft 10, the grip 12 and the club head 14. Each of these elements is used in this invention as they are conventionally used. The grip is where the club is held, and the club head is used to strike the ball. While the illustrated embodiment has the shape of a wood (e.g., driver, 3-wood, 5-wood, etc.) any club head could be mounted on shaft 10 for use herein.

The unconventional parts of this invention are the swing weight shaft 16 and the swing weights 18. As shown in FIG. 3, the swing weight shaft 16 overlaps the conventional golf club shaft 10, from the end thereof (under the grip 12) to a point slightly (e.g., about 1-5 inches, preferably about 2 inches) beyond the end of the grip. The grip covers the coextensive shafts as illustrated. The angle of the swing weight shaft is designed to allow free rotation of the swing weights, and was developed through extensive testing. A preferred angle of about 22.5 degrees is used herein, but other angles may be employed if desired, so long as the weights rotate freely.

The swing weights 18 are the heart of this swing training device. They function to promote a proper swing path and the wrist or hand release necessary to prevent hooking and/or slicing. While two swing weights are illustrated, one, three, or more weights may be mounted on the end of the swing weight shaft, to provide increased (or decreased) assistance in developing a proper swing.

The preferred swing weights are round rubber sections, e.g., formed from hockey pucks. However, any formable shape may be employed, and rubber is used only for convenience. Other materials could be employed, e.g., plastics, metal, etc., but safety considerations during use make rubber an advantageous material.

The swing weights are mounted to the swing shaft in an off-center manner. This promotes the swing weight rotation during the golf swing. Other mounting locations could be employed, but the degree of weight shift would be reduced. Advantageously the weights are provided with bearings (not shown) to promote a smooth rotation about the screw member (not shown)

on which they are mounted, which screw member extends into the free end of the swing weight shaft. The length of the screw member is adequate to accept and securely retain up to three or four (or more) swing weights, as may be desired by the user, and simply by unscrewing the screw member, weights may be added or taken off the training club.

Figure 4:
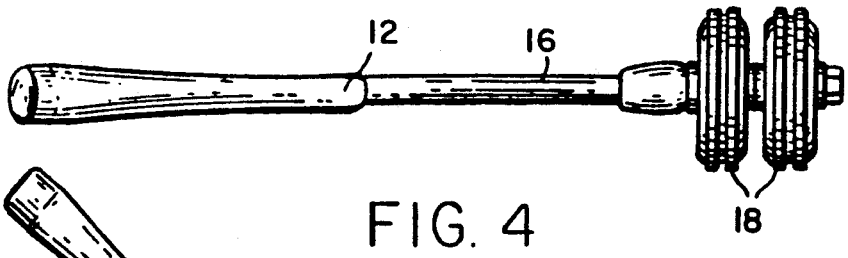
FIG. 4 shows a top plan view of an alternative embodiment of the golf swing training and exercising apparatus of the present invention.
Figure 5:
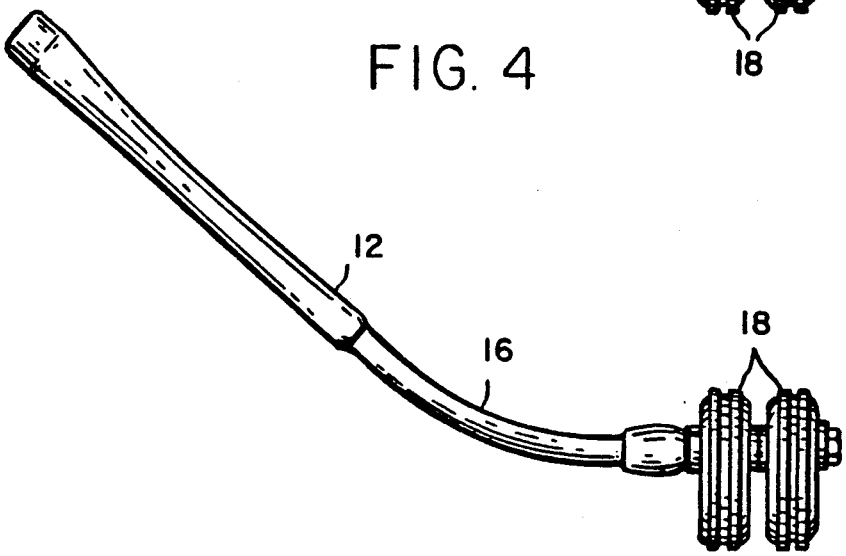
FIG. 5 shows a side elevational view of the apparatus of FIG. 4.
Figure 6:
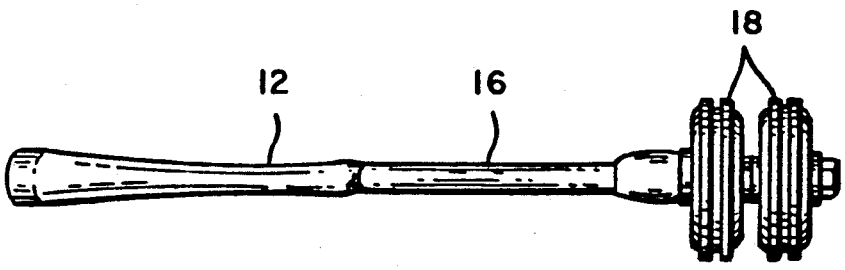
FIG. 6 shows a top bottom plan view of the apparatus of FIG. 4.

An example of the indoor embodiment of a swing training device in accordance with the present invention is illustrated in FIGS. 4, 5 and 6. As illustrated, the main elements of this embodiment of the swing trainer according to the teachings of this invention are:

(a) the grip 12;

(b) the angled weight shaft 16; and (c) swing weights 18.

Each of the main elements of this device may be broken down into their respective functions according to the features offered to the user.

In the case of the indoor golf swing trainer illustrated in FIGS. 4, 5 and 6, the entire club is made up of unconventional components.

As shown in FIG. 5, the swing weight shaft 16 is provided at one end with a grip 12, and at the other end with swing weights 18. Advantageously, the swing weight shaft is a hollow pipe, but if desired, the shaft may be a solid rod of appropriate dimension. Brass rod makes a suitable swing training shaft, particularly when a heavily weighted shaft is desired.

While two swing weights are illustrated, one, three, or more weights may be mounted on the end of the swing weight shaft, to provide increased (or decreased) assistance in developing a proper swing.

As with the outdoor model, the preferred swing weights are round rubber sections, e.g., formed from hockey pucks. However, any desired shape may be employed, and rubber is used only for convenience. Other materials could be employed, e.g., plastics, metal, etc., but safety considerations during use make rubber an advantageous material.

The swing weights are mounted to the swing shaft in an off-center manner. This promotes the swing weight rotation during the golf swing. Other mounting locations could be employed, but the degree of weight shift would be reduced. Advantageously the weights are provided with bearings (not shown) to promote a smooth rotation about the screw member (not shown) on which they are mounted, which screw member extends into the free end of the swing weight shaft. The length of the screw member is adequate to accept and securely retain up to three or four (or more) swing weights, as may be desired by the user, and simply by unscrewing the screw member, weights may be added or taken off the training club.

The present invention will be further illustrated with reference to the following examples which aid in the understanding of the present invention, but which are not to be construed as limitations thereof.

EXAMPLE 1

Indoor Swing Training Club

Step One

The basic component of the indoor training club is metal (e.g., copper or steel) rod, pipe or tubing having an outer diameter (OD) of about ¾ inch and an inner diameter (ID) of about ⅝ inch. Usually this material is available in 10 or 20 foot lengths, which for this embodiment is then cut to lengths of about 16 ¾inches. Commercial sources of suitable material may be found nationwide. Local sources for the present inventor include Electric Supply, Burlington, Mass.; Central Steel, Somerville, Mass.; and Ryerson Steel, Allston, Mass.

Step Two

The swing weight end of the club is assembled first. A ⅝" OD hex coupling 1¾" long is employed. Drill two dimples on one flat side of the hex coupling, not more than about ⅛ inch deep or about 3/16 inch in diameter. The dimples should be located about ¾ inch and 1¼ from one end of the coupling. The hex coupling, which has a continuous ⅜"×16 internal thread extending end to end, will be referred to below as having ends A and B. Commercial sources of a suitable coupling may be found nationwide. Local sources for the present inventor include Allied Bolt and Screw, Boston, Mass.

Step Three

Line up dimpled flat end B of the hex coupling from Step 2, with one open end of the 16¾ inch long pipe from Step 1. The pipe or tubing will now be referred to as a shaft having two ends A and B. Draw a center line on end A of the pipe approximately two inches long, and mark center lines from end A at 1" and 1½" respectively. With the flat dimpled surface of the hex coupling centered on line, drive end B of the coupling into end A of the shaft, until a reveal of ¼" is visible inside end A of shaft.

Step Four

Dimple the exterior surface of the shaft into the dimples on the hex coupling utilizing a punch and hammer, at premarked points. Using a hard surface bend exterior end A inward slightly to retain the hex coupling. A small sledge hammer does this well.

Step Five

Bending of the shaft is accomplished with a ½" thin-wall tubing bender. Bend the tubing to about 22.5 degrees making sure that the dimples face the outside surface of the radius.

Step Six

Advantageously, a rubber protective tip is next installed over the coupling end of the bent shaft. This item protects the coupling and is also decorative. A preferred protective tip material is a furniture or crutch tip having a ¾" inside diameter. Commercial sources of a suitable protective tip may be found nationwide. Local sources for the present inventor include J. P. O'Connor Hardware, Billerica, Mass.

Step Seven

Next the grip is installed. Taking a grip having a 0.70 inch ID, line up the inside of the shaft radius with face of grip. Apply double faced grip tape to the shaft, to a length not exceeding the length of the golf grip. The overall lengths of golf club grips differ from manufacturer to manufacturer, and any commercial grip will suffice herein. Commercial sources of a suitable protective tip may be found nationwide, and include; Golf Pride, Tacki Mac, Compass Golf, Golf Works, Golf Smith, Jack Pace Golf, Pro Swing, and the like.

Step Eight—The Weight System

The preferred weights employed herein are 3 inch diameter round by 1 inch thick, 4 ounce rubber discs.

They are routed on the outside edges as well as in the center of the outside diameter. As a convenient source, the present inventor has employed conventional hockey pucks, decoratively routed with cove and straight bits. Commercial sources of hockey pucks include; Can Star, Canada, In Glas, Canada and Cooper, Canada. Local sources of hockey pucks include most sporting goods stores, e.g., Hermans Sports, Burlington, Mass. and hockey arenas, e.g., Skate Three, Tyngsboro, Mass.

Step Nine

Drill a $\frac{5}{8}$ inch hole, $\frac{5}{8}$ inches toward the center of the hockey puck, on the flat surface, as measured from the edge of the puck. This is accomplished by drawing a center line on the flat surface of the puck. Install in this hole a $1\frac{1}{8}$ inch long by $\frac{1}{2}$ inch ID by $\frac{5}{8}$ inch OD oilite bearing. Commercial sources of a suitable bearing may be found nationwide. Local sources for the present inventor include Atlantic Bearing, Somerville, Mass.

Step Ten

To assemble the swing weights on the shaft, follow this procedure:

Using a $\frac{3}{8}$ inch$\times$16 inch, continuous thread carriage bolt, slide a $\frac{7}{8}$ inch$\times\frac{1}{2}$ inch$\times$3/16 inch thick oilite washer over the thread and up to the head. Follow this with a $1\frac{1}{4}$ inch$\times\frac{3}{8}$ inch$\times\frac{1}{2}$ inch OD flange bushing. Next slide on a weight, prepared as in Step. 8. Follow this with a simple $\frac{3}{8}$ inch flat washer, then (if desired) another weight. Slide on another flange bushing, and screw the carriage bolt into the coupling end of the shaft until snug. Commercial sources of this hardware may be found nationwide. Local sources for the present inventor include Atlantic Bearing, Somerville, Mass. and Allied Bolt and Screw, Boston, Mass.

EXAMPLE 2

Outdoor Swing Training Club

Step One

Repeat Steps (1)-(5) of Example 1. Then insert an 18 inch by $\frac{5}{8}$ inch drill bit attached to an electric drill down the butt end of the shaft. Drill a $\frac{5}{8}$ inch diameter hole, file and clean the hole all burrs.

Step Two

Next a golf club shaft is roughened at the butt end to a length of 10 to 12 inches to accept epoxy. Insert tip of golf shaft into butt of the weight shaft through the exit hole formed in Step (1) until only the rough surface only is exposed at butt. Mix a 24 hour two part epoxy, and apply it to the roughed surface of the golf shaft. Push the epoxy coated golf shaft into the weight shaft until the butt ends of both shafts are even. Clean excess epoxy off all exposed surfaces. At the butt end of weight shaft, approximately $\frac{1}{2}$ inch from the end, drill four equally spaced $\frac{1}{8}$ inch diameter holes through both shafts. Install $\frac{1}{8}$ inch$\times\frac{1}{4}$ inch pop rivets therein with pop rivet tool. Commercial sources of golf club shafts may be found nationwide and include Apollo, True Temper, Brunswick, Aldila, and Grafalloy.

Step Three

Follow Step 7 of Example 1 to install the grip over the two coextensive shafts at the butt end.

Step Four

Follow Steps 8-10 of Example 1 to install the swing weights on the end of the swing weight shaft.

Step Five

The last step of this embodiment is to cut the tip end of the golf club shaft to the desired length for the type of golf club head to be used. A multitude of heads (e.g., woods and irons) and shaft types and lengths can be employed. All necessary measurements as to lengths of shafts are available from the manufacturers of shafts and/or club heads, and are well known by those having ordinary skill in this art. Commercial sources of golf club heads may be found nationwide and include Golfsmith and Golf Works.

The foregoing description is offered primarily for purposes of illustrative teachings that are adaptable to a variety of sports and dependent training apparatus. It will become readily apparent to those skilled in the art that variations and modifications described herein, as well as alternative expedients and components, e.g., structural materials and features may be introduced without departing from the spirit and scope of the invention as defined by the present claims. Therefore, the scope of the present invention is to be limited only by the claims which follow.

What is claimed is:

1. An indoor golf swing training and exercise apparatus for simulating the proper swing path and for exercising the golf swing muscles comprising in combination a shaft having two ends, said shaft being from about 15 to 25 inches in length, said shaft having a golf grip at one end thereof and a non-grip end at the other end thereof; said shaft further having an angular bend of about 22.5 degrees at the non-grip end thereof; and wherein said non-grip end of the shaft terminates with one or more independently rotatable off-center mounted swing weights.

2. The training and exercise apparatus of claim 1, wherein the shaft is a hollow metal pipe or tube.

3. The training and exercise apparatus of claim 2, wherein the hollow metal pipe or tube is copper, steel, or aluminum tubing having an outer diameter of about $\frac{3}{4}$ inch.

4. The training and exercise apparatus of claim 3, wherein the solid metal rod is a brass rod having an outer diameter of up to about $\frac{3}{4}$ inch.

5. The training and exercise apparatus of claim 1, wherein the shaft is a solid metal rod.

6. The training and exercise apparatus of claim 1, wherein each of the swing weights is a round rubber disk, about 3 inches in diameter and about 1 inch thick.

7. The training and exercise apparatus of claim 6, wherein the swing weight is mounted off-center via a hole placed about $\frac{5}{8}$ inches from the outside edge toward the center of the rubber disk.

8. An indoor golf swing training and exercise apparatus for simulating the proper swing path and for exercising the golf swing muscles comprising in combination:

(a) a metal shaft having two ends, said shaft being selected from the group consisting of hollow steel, copper and aluminum pipes or tubes of up to about $\frac{3}{4}$ inch in outer diameter, and from about 15 to 25 inches in length, said shaft having a golf grip applied to one end thereof;

(b) said shaft further having an angular bend of about 22.5 degrees at the non-grip bearing end thereof; and (c) wherein non-grip bearing end of the shaft terminates with one or more independently rotatable off-center mounted swing weights, each of said swing weights being a segment of rubber material in the shape of a disk, about 3 inches in diameter and about 1 inch thick.

9. An outdoor golf swing training and exercise apparatus for simulating the proper swing path and for exercising the golf swing muscles comprising in combination:

(a) a tubular metal first shaft having two ends, said first shaft being from about 15 to 25 inches in length, said first shaft having a golf grip at one end thereof; said first shaft further having an exit hole about 18 inches below the grip end, said hole being before an angular bend of about 22.5 degrees located at the non-grip end thereof;

(b) a second shaft, attached at the grip end to the interior of the grip end of said first shaft, and extending outwardly through the hole in said first shaft, extending beyond the angular bend of said first shaft and wherein free end of said second shaft terminates with a golf club head; and (c) wherein the non-grip end of the first shaft terminates with one or more independently rotatable off-center mounted swing weights.

10. The training and exercise apparatus of claim 9, the hollow metal first shaft is copper, steel, or aluminum tubing having an outer diameter of about ¾ inch.

11. The training and exercise apparatus of claim 9, wherein each of the swing weights is a round rubber disk, about 3 inches in diameter and about 1 inch thick.

12. The training and exercise apparatus of claim 11, the swing weight is mounted off-center via a hole placed about ⅝ inches from the outside edge toward the center of the rubber disk.

* * * * *